US010669821B2

(12) United States Patent
Knight et al.

(10) Patent No.: US 10,669,821 B2
(45) Date of Patent: Jun. 2, 2020

(54) CHARGE TUBE ASSEMBLY

(71) Applicant: G&H Diversified Manufacturing LP, Houston, TX (US)

(72) Inventors: Benjamin Knight, Houston, TX (US); Kary Meadows, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 15/962,569

(22) Filed: Apr. 25, 2018

(65) Prior Publication Data

US 2019/0330961 A1 Oct. 31, 2019

(51) Int. Cl.
*E21B 43/117* (2006.01)
*E21B 43/1185* (2006.01)

(52) U.S. Cl.
CPC ..... *E21B 43/117* (2013.01); *E21B 43/1185* (2013.01)

(58) Field of Classification Search
CPC .. E21B 43/117; E21B 43/1185; E21B 43/118; E21B 43/116; E21B 43/11852; E21B 43/11855; E21B 43/11857
USPC ..... 89/1.151
See application file for complete search history.

(56) References Cited

U.S. PATENT DOCUMENTS 3,174,547 A * 3/1965 Fields ..... E21B 27/02 166/100
6,354,219 B1 * 3/2002 Pratt ..... E21B 43/117 102/306
6,851,471 B2 * 2/2005 Barlow ..... E21B 17/042 102/307
7,441,601 B2 * 10/2008 George ..... E21B 43/117 166/297
9,238,956 B2 * 1/2016 Martinez ..... E21B 43/117
9,903,185 B2 * 2/2018 Ursi ..... E21B 43/117
10,174,595 B2 * 1/2019 Knight ..... E21B 43/117
10,188,990 B2 * 1/2019 Burmeister ..... B01D 61/20
2002/0134585 A1 * 9/2002 Walker ..... E21B 43/117 175/4.51
2003/0047358 A1 * 3/2003 Bonkowski ..... E21B 43/116 175/4.6
2004/0129415 A1 * 7/2004 Xi ..... E21B 43/116 166/55.1
2007/0084336 A1 * 4/2007 Neves ..... E21B 43/119 89/1.3
2008/0149338 A1 * 6/2008 Goodman ..... E21B 43/117 166/299
2008/0295678 A1 * 12/2008 George ..... E21B 43/117 89/1.151
2009/0242198 A1 * 10/2009 Evans ..... E21B 43/119 166/250.01
2010/0133004 A1 * 6/2010 Burleson ..... E21B 43/116 175/2
2010/0300750 A1 * 12/2010 Hales ..... E21B 43/117 175/2

(Continued)

*Primary Examiner* — Joshua E Freeman
(74) *Attorney, Agent, or Firm* — Conley Rose, P.C.

(57) ABSTRACT

A charge tube assembly for a perforating gun includes a charge tube configured to receive an explosive shaped charge, and a first endplate configured to couple to a first end of the charge tube, the first endplate including a first faceplate coupled to a first body, wherein the first faceplate includes a first material and the first body includes a second material that is different from the first material.

19 Claims, 14 Drawing Sheets

(56) References Cited

U.S. PATENT DOCUMENTS

| | | | | |
|---|---|---|---|---|
| 2011/0000669 | A1* | 1/2011 | Barlow | E21B 43/117 166/297 |
| 2014/0000877 | A1* | 1/2014 | Robertson | E21B 23/00 166/250.15 |
| 2015/0027302 | A1* | 1/2015 | Wall | E21B 43/11852 89/1.15 |
| 2015/0226044 | A1* | 8/2015 | Ursi | E21B 43/119 166/55 |
| 2016/0273281 | A1* | 9/2016 | Bell | E21B 29/02 |
| 2017/0115102 | A1* | 4/2017 | Knight | E21B 43/117 |
| 2017/0122083 | A1* | 5/2017 | Wilson | E21B 43/117 |
| 2017/0211363 | A1* | 7/2017 | Bradley | F42B 3/08 |
| 2017/0268317 | A1* | 9/2017 | Von Kaenel | E21B 43/116 |
| 2018/0112500 | A1* | 4/2018 | Collins | E21B 43/117 |
| 2018/0119529 | A1* | 5/2018 | Goyeneche | E21B 43/117 |
| 2018/0119530 | A1* | 5/2018 | Skinner | E21B 43/1185 |
| 2018/0135389 | A1* | 5/2018 | Sullivan | E21B 43/117 |
| 2018/0298732 | A1* | 10/2018 | Haggerty | E21B 43/116 |
| 2019/0040722 | A1* | 2/2019 | Yang | E21B 43/117 |
| 2019/0085664 | A1* | 3/2019 | Hardesty | E21B 43/119 |
| 2019/0148861 | A1* | 5/2019 | Ross | H01R 13/005 166/65.1 |
| 2019/0153827 | A1* | 5/2019 | Goyeneche | F42B 1/02 |
| 2019/0186243 | A1* | 6/2019 | Huang | E21B 43/1185 |

* cited by examiner

CHARGE TUBE ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, once the casing string has been perforated by the perforating gun and the downhole plug has been set, a ball or dart may be pumped into the wellbore for landing against the set downhole plug, thereby isolating the portion of the wellbore extending uphole from the set downhole plug. With this uphole portion of the wellbore isolated, the formation extending about the perforated section of the casing string may be hydraulically fractured by fracturing fluid pumped into the wellbore.

BRIEF SUMMARY OF THE DISCLOSURE

An embodiment of a charge tube assembly for a perforating gun comprises a charge tube configured to receive an explosive shaped charge, and a first endplate configured to couple to a first end of the charge tube, the first endplate including a first faceplate coupled to a first body, wherein the first faceplate comprises a first material and the first body comprises a second material that is different from the first material. In some embodiments, the charge tube assembly further comprises a second endplate configured to couple to a second end of the charge tube, the second endplate including a second faceplate coupled to a second body, and wherein the second faceplate comprises a third material and the second body comprises a fourth material that is different from the third material. In some embodiments, the first material comprises an electrically conductive material and the second material comprises an electrically insulating material. In certain embodiments, the first body comprises a molded portion that is molded to the first faceplate. In certain embodiments, the first faceplate comprises an annular surface having radially inner and outer ends and wherein the body comprises a central passage. In some embodiments, the first faceplate comprises a ground spring that extends from the annular surface of the first faceplate. In some embodiments, the first faceplate comprises a ground tab that extends from the annular surface, and wherein the ground tab is configured to receive a fastener to couple the first endplate with the charge tube. In certain embodiments, the first faceplate comprises an alignment tab that extends radially outward from the radially outer end of the first faceplate, and wherein the alignment tab is configured to angularly align the charge tube with a housing of the perforating gun, and the alignment tab comprises a rounded lip. In some embodiments, the first faceplate comprises a port extending through the annular surface of the first faceplate, and wherein the port is configured to communicate pressure from a central passage of the charge tube when the first endplate is coupled to the charge tube. In some embodiments, the radially outer end of the first faceplate comprises a rounded lip.

An embodiment of a perforating gun comprises a housing comprising an inner surface, a charge tube insertable into the housing and configured to receive an explosive shaped charge, and a first endplate configured to couple to a first end of the charge tube, the first endplate including a first faceplate coupled to a first body, wherein the first faceplate comprises a first material and the first body comprises a second material that is different from the first material. In some embodiments, the first material comprises an electrically conductive material and the second material comprises an electrically insulating material. In some embodiments, the first body comprises a molded portion that is molded to the first faceplate. In certain embodiments, the first faceplate comprises an annular surface having radially inner and outer ends and wherein the body comprises a central passage, the first faceplate comprises a ground tab that extends from the annular surface, and wherein the ground tab is configured to receive a fastener to couple the first endplate with the charge tube, and the first faceplate comprises an alignment tab that extends radially outward from the radially outer end of the first faceplate, and wherein the alignment tab is insertable into an alignment slot formed in the inner surface of the housing. In some embodiments, the alignment tab of the first faceplate comprises a rounded lip. In some embodiments, the perforating gun further comprises a second endplate configured to couple to a second end of the charge tube, the second endplate including a second faceplate coupled to a second body, and wherein the second faceplate comprises a third material and the second body comprises a fourth material that is different from the third material.

An embodiment of a method for forming a perforating gun comprises coupling a faceplate of an endplate of the perforating gun to a body of the endplate, wherein the faceplate comprises a first material and the body comprises a second material that is different from the first material, coupling an explosive shaped charge to a charge tube of the perforating gun, coupling the endplate to a first end of the charge tube, and disposing the charge tube in a central passage of a housing of the perforating gun. In some embodiments, coupling the faceplate of the endplate to the body of the endplate comprises molding the body to the faceplate to form the endplate, and the first material comprises an electrically conductive material and the second material comprises an electrically insulating material. In some embodiments, the method further comprises angularly aligning an alignment tab of the endplate with an alignment slot formed in the housing, and inserting the alignment tab of the endplate into the alignment slot of the housing. In certain embodiments, the method further comprises physically contacting a ground spring of the faceplate with an end of a tool coupled to the housing.

BRIEF DESCRIPTION OF THE DRAWINGS

For a detailed description of exemplary embodiments of the disclosure, reference will now be made to the accompanying drawings in which.

DETAILED DESCRIPTION

Figure 1:
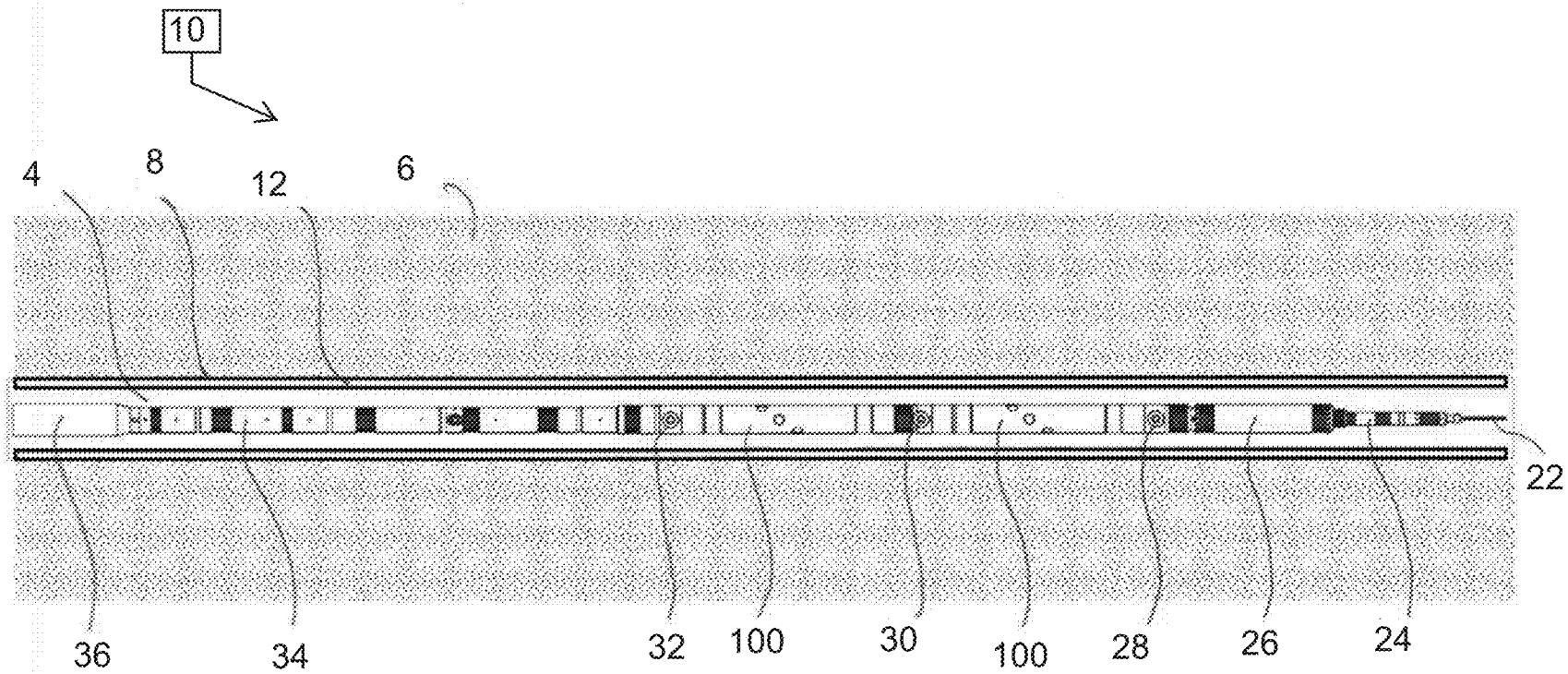
FIG. 1 is a schematic, partial cross-sectional view of a system for completing a subterranean well including an embodiment of a setting tool in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. In this embodiment, completion system 10 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 10 may further include suitable surface equipment for drilling, completing, and/or operating completion system 10 and may include, in some embodiments, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 generally includes a cable head 24, a casing collar locator (CCL) 26, a direct connect sub 28, a plurality of perforating guns 100, a switch sub 30, a plug-shoot firing head 32, a setting tool 34, and a downhole or frac plug 36 (shown schematically in FIG. 1). Cable head 24 is the uppermost component of tool string 20 and includes an electrical connector for providing electrical signal and power communication between the wireline 22 and the other components (CCL 26, perforating guns 100, setting tool 34, etc.) of tool string 20. CCL 26 is coupled to a lower end of the cable head 24 and is generally configured to transmit an electrical signal to the surface via wireline 22 when CCL 26 passes through a casing collar, where the transmitted signal may be recorded at the surface as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating guns 100 and associated tools, such as the setting tool 34 and downhole plug 36.

Perforating guns 100 of tool string 20 are coupled to direct connect sub 28 and are generally configured to perforate casing string 12 and provide for fluid communication between formation 6 and wellbore 4. As will be discussed further herein, perforating guns 100 include a plurality of explosive shaped charges that may be detonated by a signal conveyed by the wireline 22 to produce an explosive jet directed against casing string 12. In some embodiments, perforating guns 100 may comprise a hollow steel carrier (HSC) type perforating gun, a scalloped perforating gun, or a retrievable tubing gun (RTG) type perforating gun. Perforating guns 100 may comprise a wide variety of sizes such as, for example, 2¾", 3⅛", or 3⅜", as well as other sizes, wherein the above listed size designations correspond to an outer diameter of perforating guns 100. Additionally, although perforating guns 100 are shown in FIG. 1 as incorporated in tool string 20, perforating guns 100 may be used in other tool strings comprising components differing from the components comprising tool string 20.

Switch sub 30 of tool string 20 is coupled between the pair of perforating guns 100 and includes an electrical conductor and switch generally configured to allow for the passage of an electrical signal to the lowermost perforating gun 100 of tool string 20. Tool string 20 further includes plug-shoot firing head 32 coupled to a lower end of the lowermost perforating gun 100. Plug-shoot firing head 32 couples the perforating guns 100 of the tool string 20 to the setting tool 34 and downhole plug 36, and is generally configured to pass a signal from the wireline 22 to the setting tool 34 of tool string 20. Plug-shoot firing head 32 may also include mechanical and/or electrical components to fire the setting tool 34.

In this embodiment, tool string 20 further includes setting tool 34 and downhole plug 36, where setting tool 34 is coupled to a lower end of plug-shoot firing head 32 and is generally configured to set or install downhole plug 36 within casing string 12 to isolate desired segments of the wellbore 4. Once downhole plug 36 has been set by setting tool 34, an outer surface of downhole plug 36 seals against an inner surface of casing string 12 to restrict fluid communication through wellbore 4 across downhole plug 36. Downhole plug 36 of tool string 20 may be any suitable downhole or frac plug known in the art while still complying with the principles disclosed herein.

Figure 2:
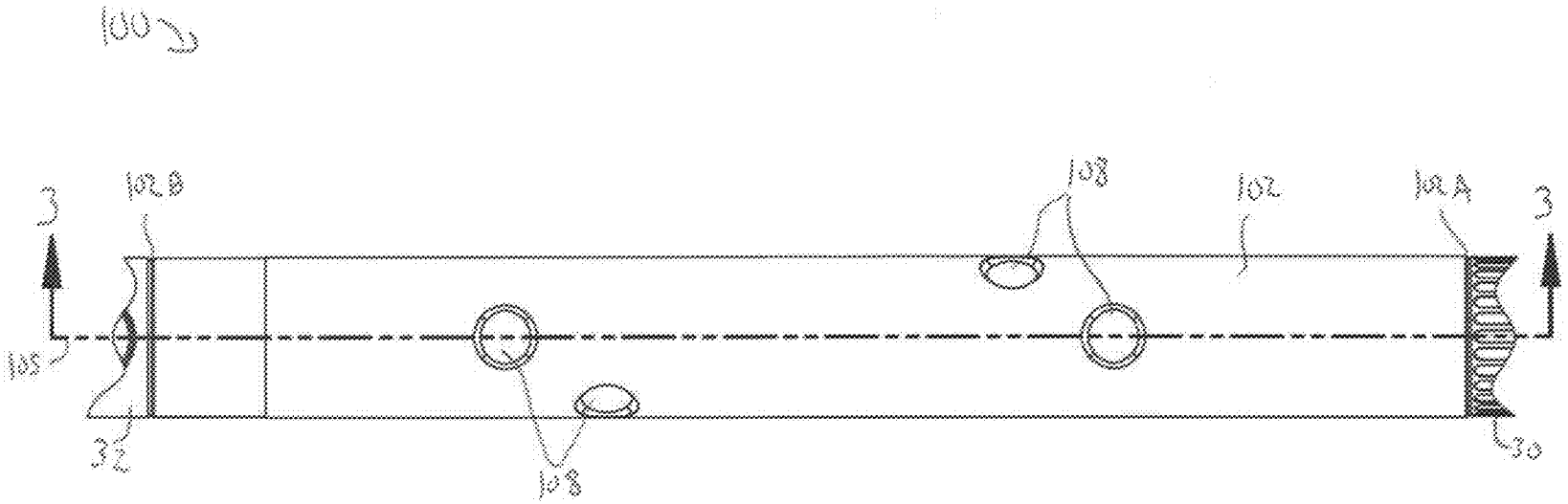
FIG. 2 is an embodiment of a perforating gun of the completion system of FIG. 1 in accordance with principles disclosed herein.
Figure 3:
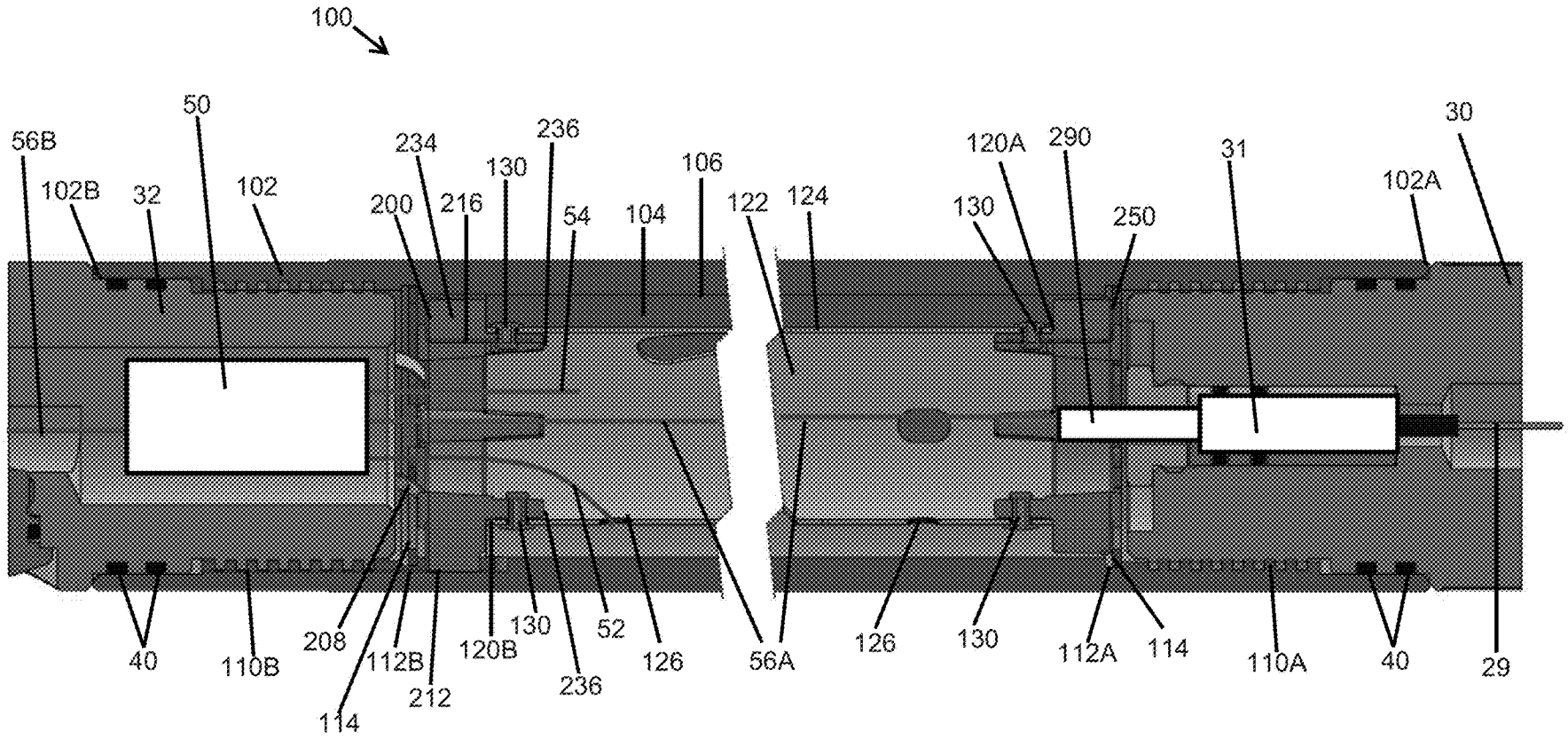
FIG. 3 is a cross-sectional view along lines 3-3 in FIG. 2 of the perforating gun of FIG. 2.
Figure 4:
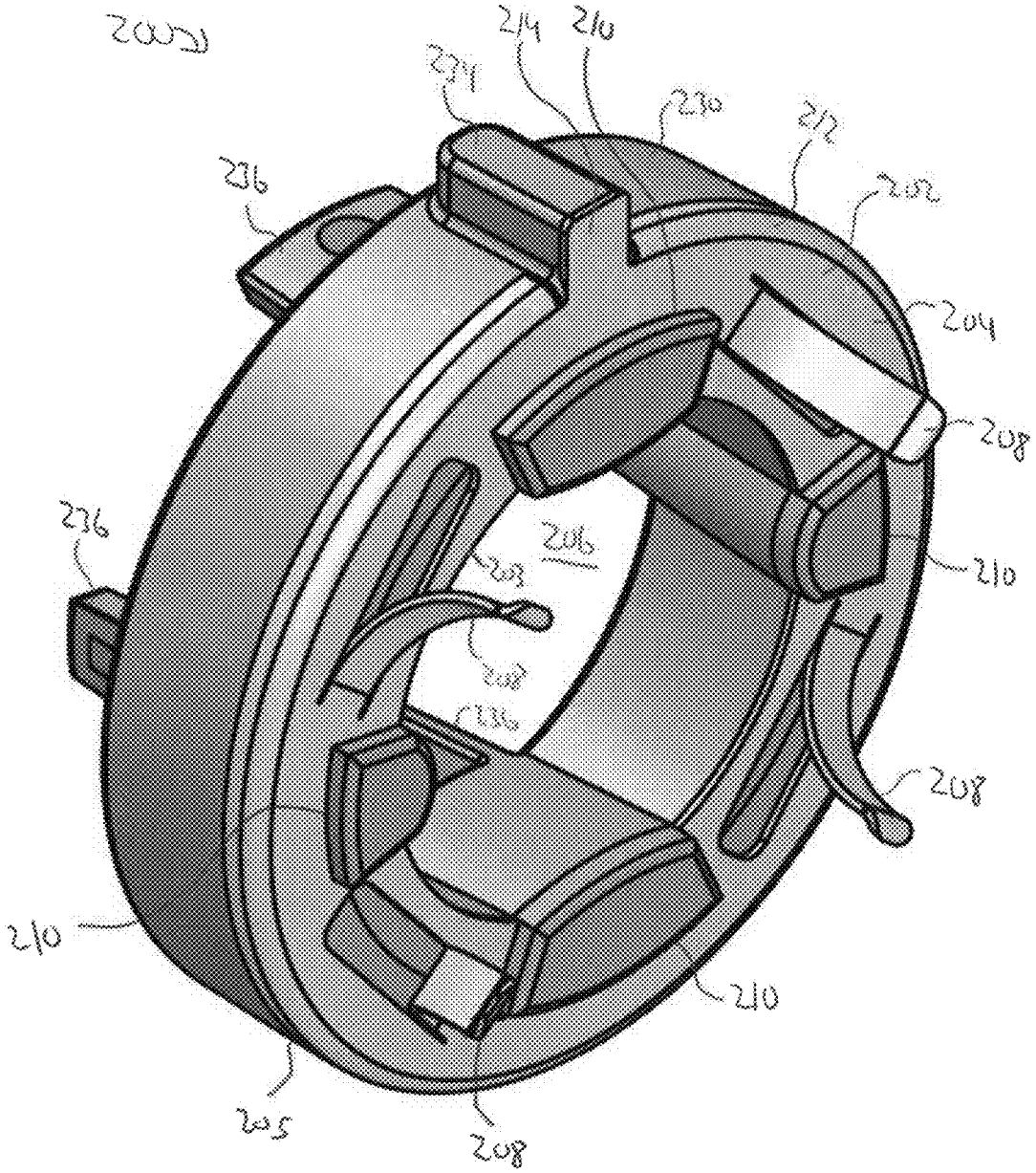
FIG. 4 is a first perspective view of an embodiment of a first endplate of the perforating gun of FIG. 2 in accordance with principles disclosed herein.
Figure 5:
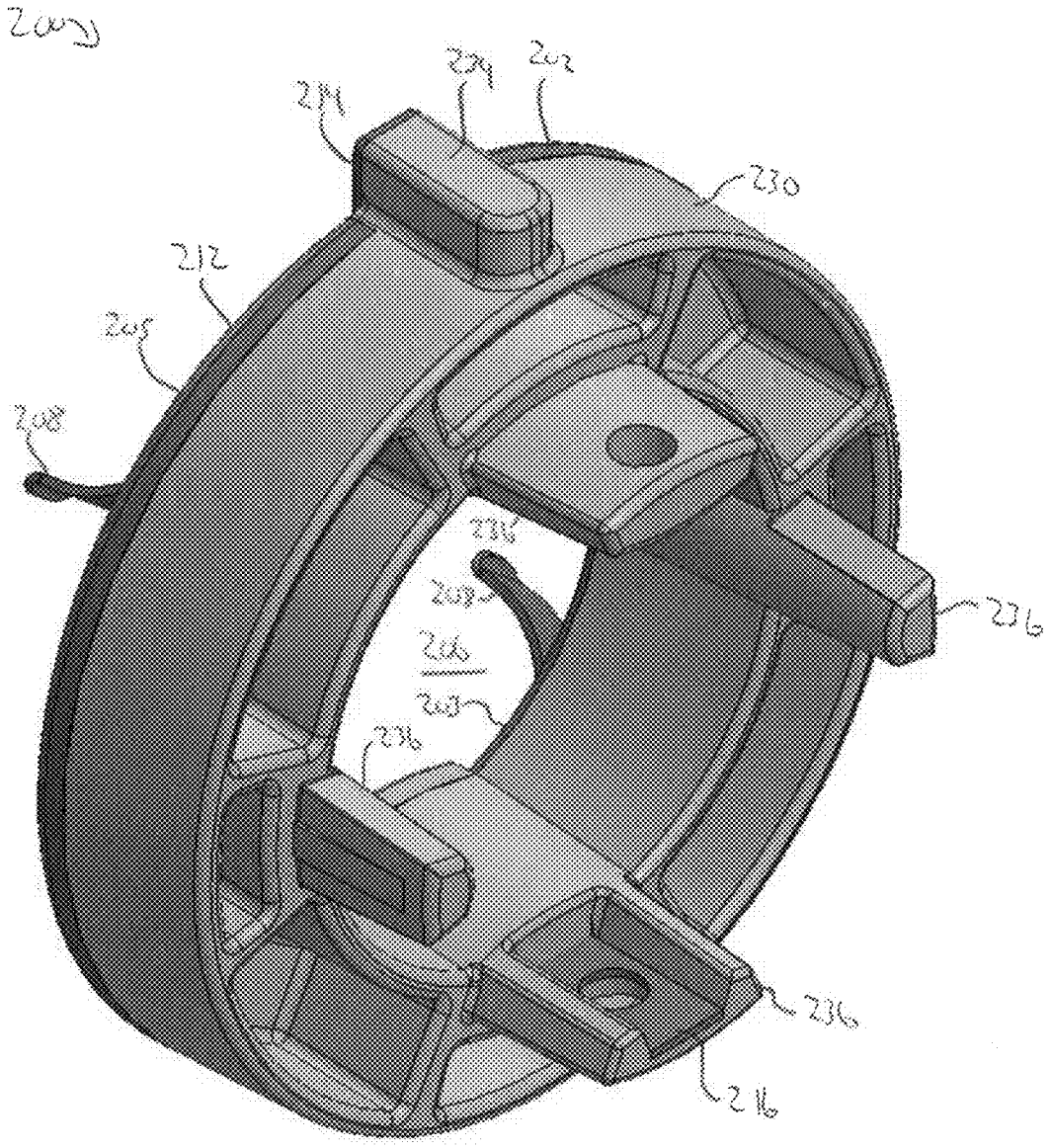
FIG. 5 is a second perspective view of the first endplate of FIG. 4.
Figure 6:
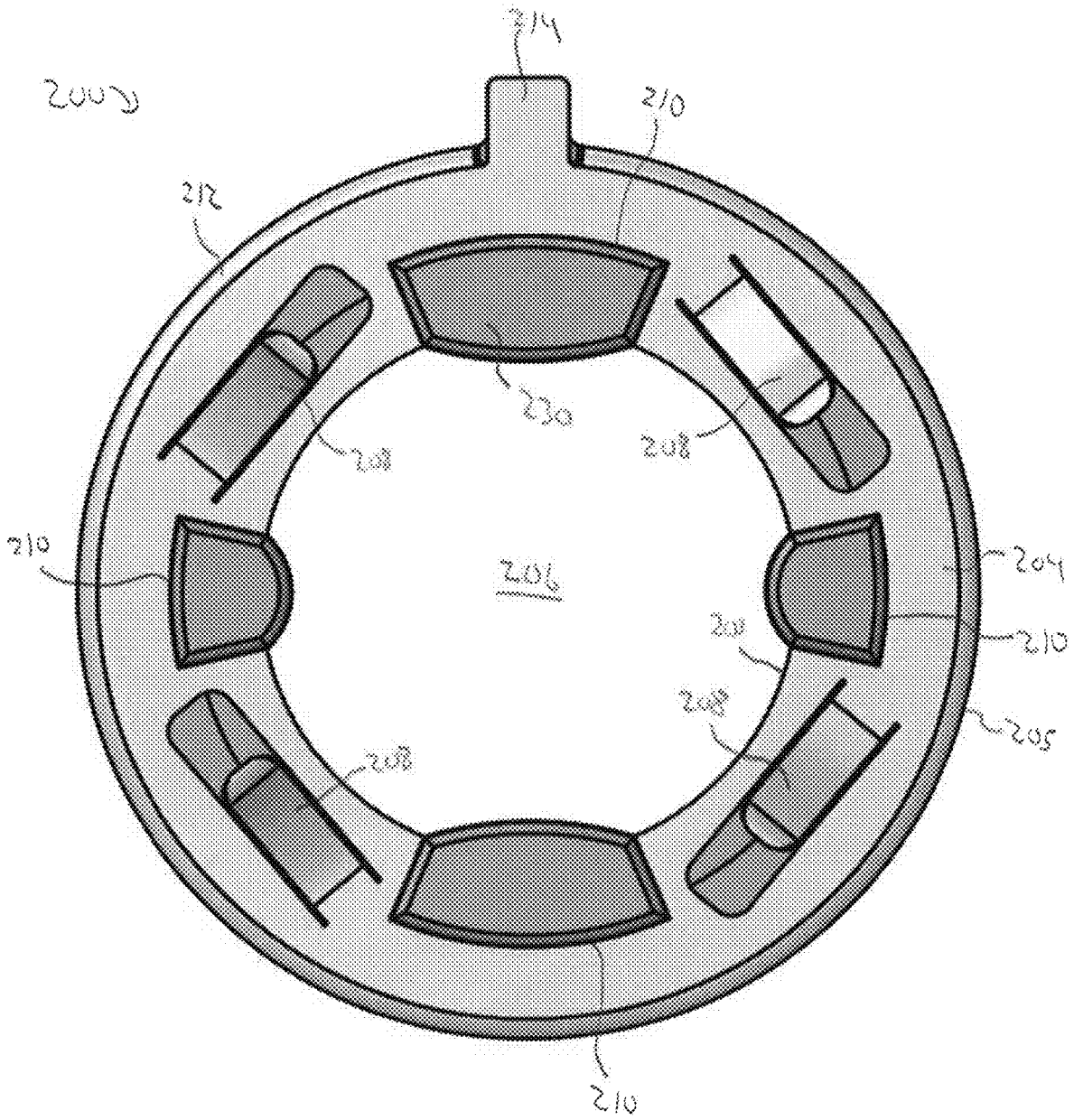
FIG. 6 is a front view of the first endplate of FIG. 4.
Figure 7:
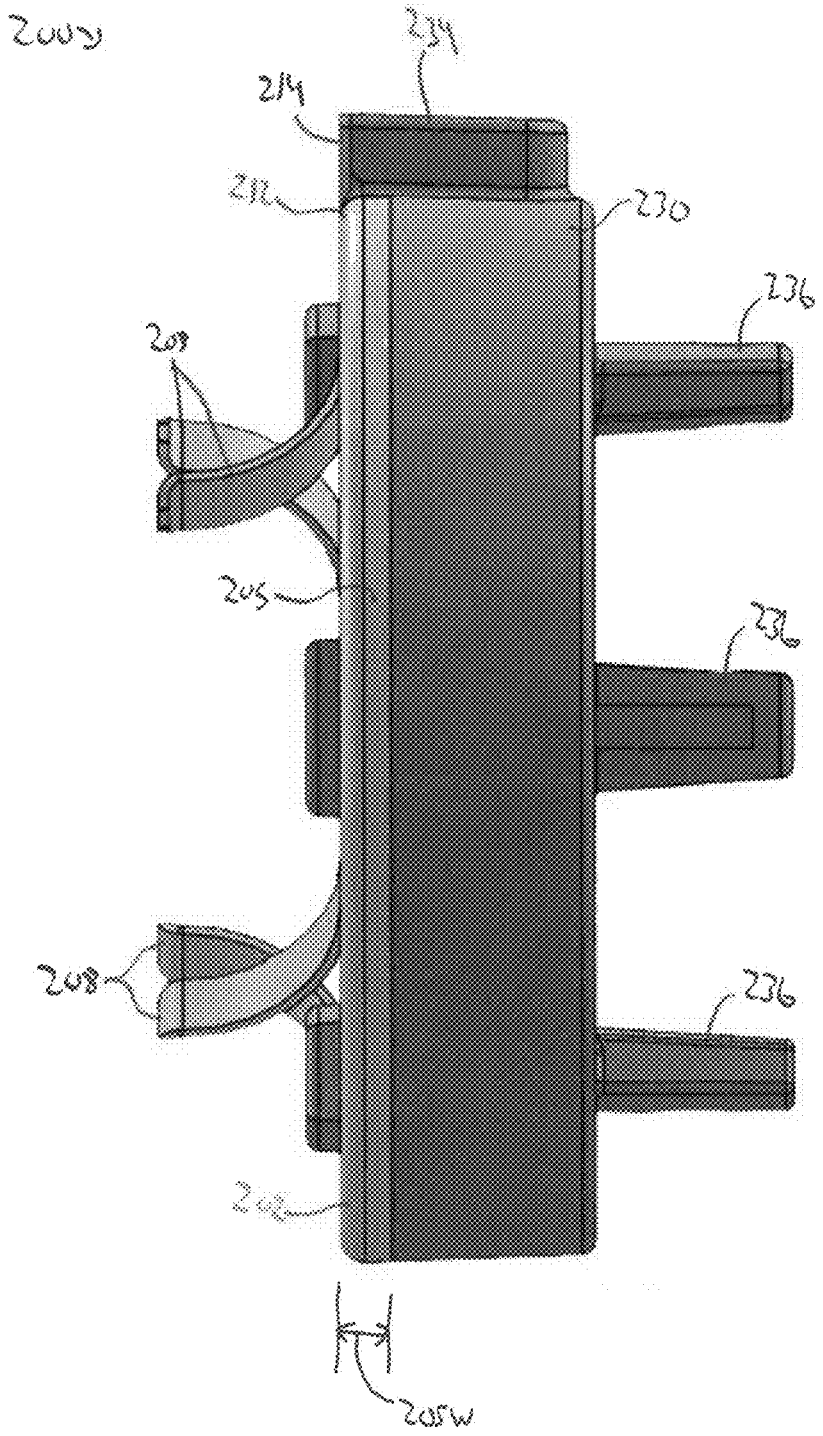
FIG. 7 is a side view of the first endplate of FIG. 4.
Figure 8:
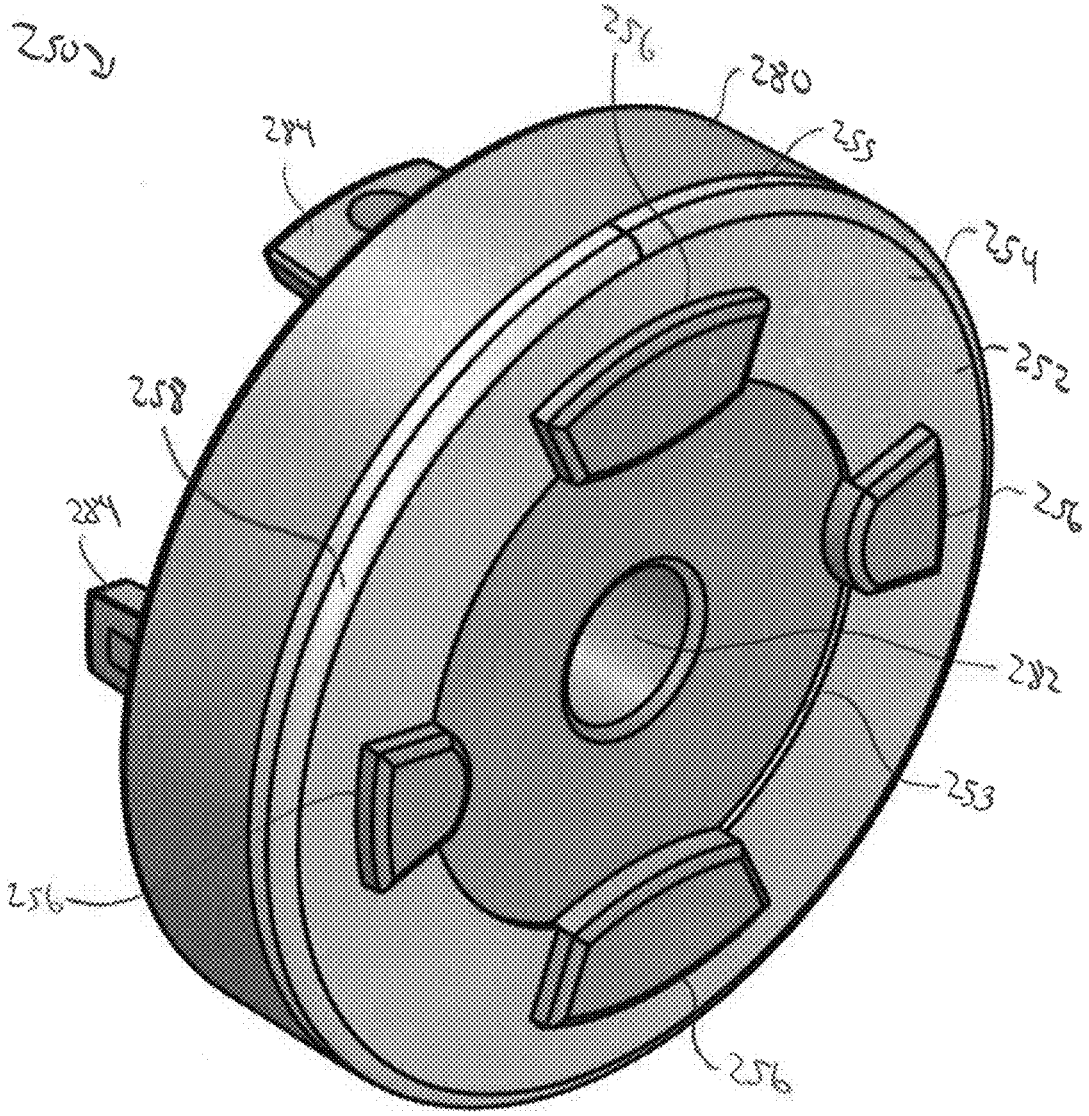
FIG. 8 is a perspective view of an embodiment of a second endplate of the perforating gun of FIG. 2 in accordance with principles disclosed herein.
Figure 9:
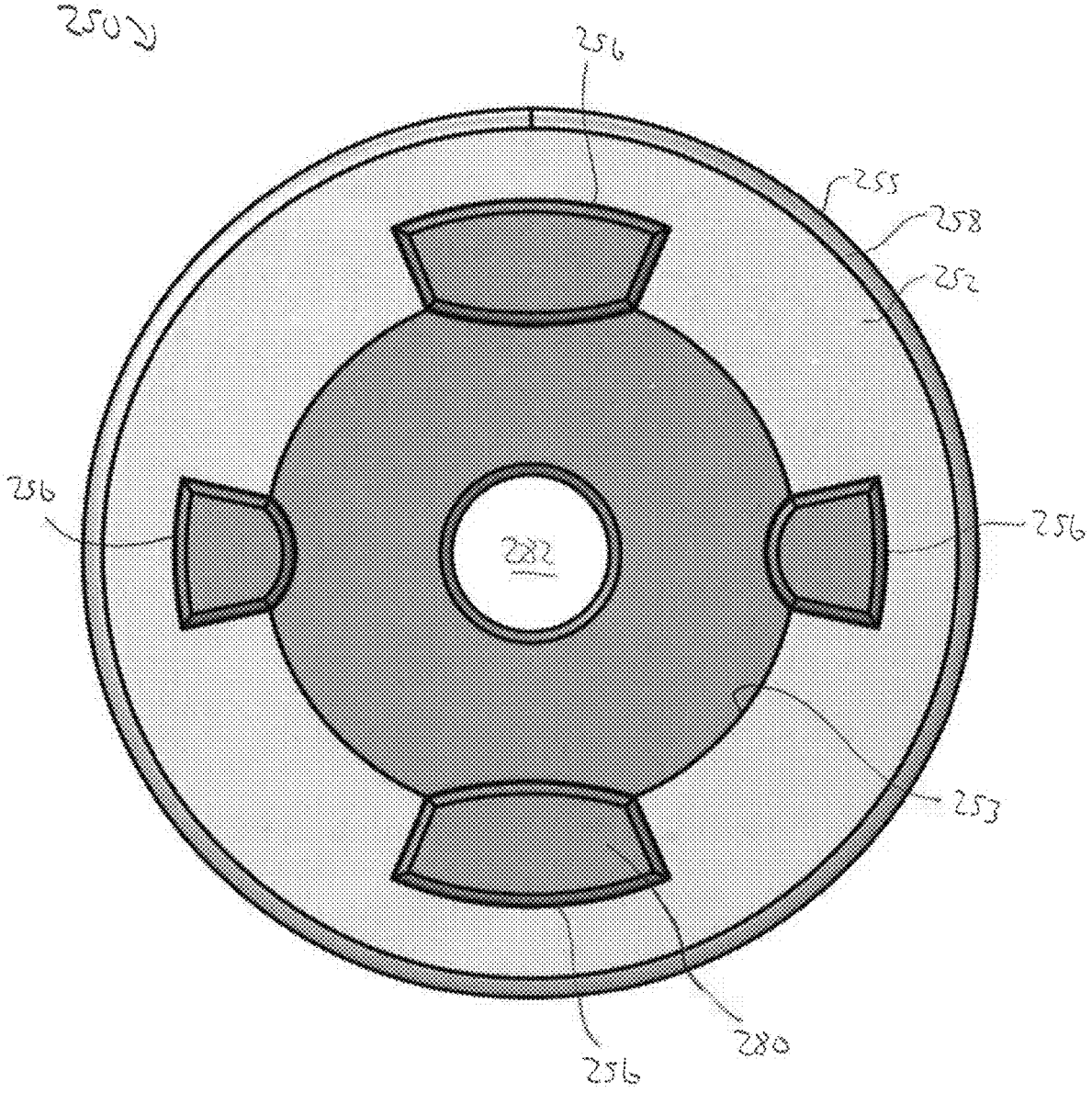
FIG. 9 is a front view of the second endplate of FIG. 8.
Figure 10:
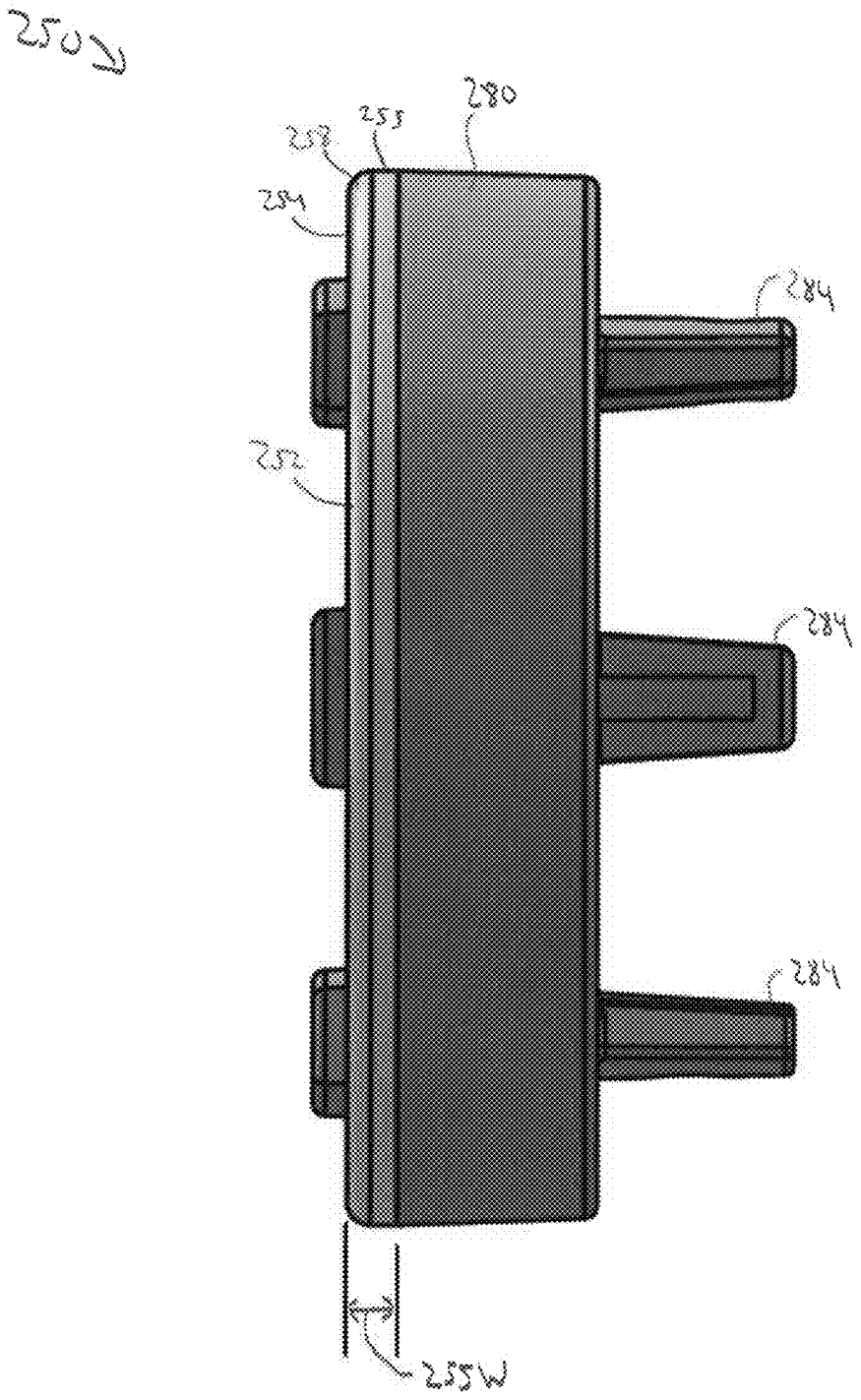
FIG. 10 is a side view of the second endplate of FIG. 8.

Referring to FIGS. 1-3, an embodiment of the perforating guns 100 of the tool string 20 of FIG. 1 is shown in FIGS. 2, 3. In the embodiment of FIGS. 2, 3, perforating gun 100 has a central or longitudinal axis 105 and generally includes an outer housing or carrier 102, a generally cylindrical charge tube 120 disposed within carrier 102, a first or lower endplate 200 coupled to charge tube 120, a second or upper endplate 250 coupled to charge tube 120, and a plurality of explosive shaped charges (not shown in FIGS. 2, 3) coupled to charge tube 120. Carrier 102 of perforating gun 100 is generally cylindrical and has a first or upper end 102A, a second or lower end 102B axially spaced from upper end 102A, and a central bore or passage 104 defined by a generally cylindrical inner surface 106 extending between ends 102A, 102B. In this embodiment, a generally cylindrical outer surface of carrier 102 includes a plurality of indentations or scallops 108 that are aligned with the shaped charges coupled to carrier tube 120. Thus, in this embodiment, perforating gun 100 comprises a scalloped perforating gun; however, in other embodiments, carrier 102 of perforating gun 100 may not include scallops 108.

In this embodiment, the inner surface 106 of carrier 102 includes a threaded first or upper connector 110A located proximal upper end 102A and a threaded second or lower connector 1106 located proximal lower end 1026. Upper connector 110A releasably couples with a corresponding threaded connector of switch sub 30 of tool string 20 while lower connector 1106 releasably couples with a corresponding threaded connector of plug-shoot firing head 32 of tool string 20. In other embodiments, the ends of carrier 102 may be connected to gun connecting members of tool string 20. In still other embodiments, carrier 102 may be connected between multiple switch subs 30. Annular seals 40 positioned between the inner surface 106 of carrier 102 and the outer surfaces of switch sub 30 and firing head 32 seal central passage 104 of carrier 102 from the surrounding environment. In this embodiment, the inner surface 106 of carrier 102 includes a first or upper retainer groove 112A located proximal upper connector 110A and a second or lower retainer groove 112B located lower connector 1106, where each retainer groove 112A, 112B receives an annular retainer or snap ring 114. In this embodiment, inner surface 106 of carrier 102 also includes an alignment slot 116 for angularly aligning charge tube 120 with carrier 102. Particularly, slot 116 assists in angularly aligning the shaped charges of charge tube 102 with scallops 108. In other embodiments, including embodiments where perforating gun 100 does not comprise a scalloped perforating gun, the inner surface 106 of carrier 102 may not include slot 116.

Charge tube 120 of perforating gun 100 is generally cylindrical and has a first or upper end 120A, a second or lower end 120B axially spaced from upper end 102A, a central bore or passage 122 extending between ends 120A, 120B, and a generally cylindrical outer surface 124 also extending between ends 120A, 120B. In this embodiment, charge tube 120 includes one or more ground apertures 126 that provide for the passage of a ground wire or cable 52 to pass therethrough. Additionally, charge tube 120 includes a plurality of apertures positioned at each end 120A, 120B for receiving fasteners 130 that couple endplates 200, 250 with charge tube 120. In this embodiment, fasteners 130 comprise rivets for riveting endplates 200, 250 to charge tube 120; however, in other embodiments, fasteners 130 may comprise other types of fasteners, including releasable fasteners, or the end plate might snap in and not require any fasteners. The combination of charge tube 120 and endplates 200, 250 may be referred to as a charge tube assembly. Endplates 200, 250 may be used for variously sized perforating guns, including 2¾", 3⅛", and 3⅜" perforating guns.

In this embodiment, a first electrical connector 31 is received in a central passage formed within switch sub 30. First electrical connector 31 provides a bulkhead seal in the central passage of switch sub 30 and includes an electrical contact for passing electrical signals and/or power downhole through tool string 20. First electrical connector 31 is connected with a signal conductor or wire 29 that is in signal communication with the wireline 22 from which tool string 20 is suspended. In this configuration, electrical signals and/or power may be transmitted from wireline 22 to first electrical connector 31 via signal wire 29.

In this embodiment, a detonator 50 (shown schematically in FIG. 3) is located at partially within plug-shoot firing head 32, detonator 50 including ground wire 52 for grounding detonator 50 at perforating gun 100. As will be described further herein, an electrical conductor pathway is formed between ground wire 52, charge tube 120, endplates 200, 250, plug-shoot firing head 32, and carrier 102. In this embodiment, to ground detonator 50 at perforating gun 100, ground wire 52 is extends through ground apertures 126 of charge tube 120 and wrapped or coiled about the outer surface 124 of charge tube 120, thereby allowing for electrical conduction between ground wire 52 and charge tube 120. In other embodiments, ground wire 52 may be coupled to the outer surface 124 (e.g., riveted or secured via a releasable fastener, etc.) without being wrapped or wound about outer surface 124. Detonator 50 also includes detonating cord 54 (partially shown in FIG. 3) extending therefrom for detonating the shaped charges coupled to charge tube 102 upon actuation of detonator 50. Particularly, a firing signal is transmittable to detonator 50 via a first signal wire or cable 56A, which may trigger detonator 50 to fire the shaped charges of perforating gun 100. Particularly, first signal wire 56A extends between detonator 50 and a second electrical connector 290 extending through upper endplate 250. As will be discussed further herein, second electrical connector 290 electrically connects with first electrical connector 31 to provide for the transmission of electrical signals and/or power between signal conductor 29 and first signal wire 56A. In some embodiments, electrical connector 290 may be coupled to upper endplate 250 while in other embodiments the electrical connector 290 may merely pass through upper endplate 250 to connect with first electrical connector 31. In this embodiment, detonator 50 comprises an integrated detonator and addressable switch assembly; however, in other embodiments, instead of the integrated detonator 50, an external addressable switch connected to a detonator may be used for selectably triggering the shaped charges of perforating gun 100. The shaped charges may be coupled to charge tube 120 via apertures (not shown) formed in charge tube 120. Additionally, detonator 50 may also pass the firing signal (as well as potentially other data signals) downhole via a second signal wire or cable 56B (partially shown in FIG. 3) extending downhole through tool string 20 from plug-shoot firing head 32. In this embodiment, detonator 50 comprises an electronically addressable detonator or detonator assembly; however, in other embodiments, detonator 50 may comprise detonators other than addressable detonators, such as a mechanically or pressure actuated switch with separate detonator, or addressable switch with separate detonator.

Referring to FIGS. 1-7, an embodiment of lower endplate 200 is shown in FIGS. 3-7. In the embodiment of FIGS. 3-7, lower endplate 200 is generally annular and comprises an annular faceplate 202, and an annular body or molded portion 230 coupled to faceplate 202. Faceplate 202 comprises a first, electrically conductive, material while molded portion 230 comprises a second material different from the first material, where the second material does not necessarily comprise an electrically conductive material. Indeed, in some embodiments, molded portion 230 of lower endplate 200 may comprise an electrically insulating material. In this embodiment, molded portion 280 is molded to faceplate 202 to form lower endplate 200. However, in other embodiments, molded portion 230 may comprise a body that is mechanically coupled with faceplate 202, such as through fasteners (e.g., threaded fasteners, rivets, etc.) or other means. In some embodiments, molded portion 230 may comprise polyether ether ketone (PEEK), polytetrafluoroethylene (PTFE), and nylon, each of which may include fiber reinforcement, as well as other materials. In some embodiments, faceplate 202 may comprise steel, aluminum, copper, and other conductive materials.

In this embodiment, faceplate 202 includes an annular surface 204 extending radially between a radially inner end 203 and a radially outer end 205, where the inner end 203 of annular surface 204 at least partially defines a central aperture or passage 206 that extends axially through lower endplate 200. Additionally, faceplate 202 includes a plurality of circumferentially spaced ground members or springs 208 that extend axially outwards from annular surface 204. Ground springs 208 are biased in an axially outwards direction from annular surface 204 such that ground springs 208 may remain in physical contact or engagement with an end of plug-shoot firing head 32, thereby allowing for electrical conduction between plug-shoot firing head 32 and the faceplate 202 of lower endplate 200 and assisting in the grounding of detonator 50.

In this embodiment, the radially inner end 203 of faceplate 202 includes a plurality of circumferentially spaced arcuate recesses 210 that assist with securing faceplate 202 to molded portion 230. Additionally, in this embodiment, an annular curved or rounded lip 212 extends between the radially outer end 205 and annular surface 204 of faceplate 202. Curved lip 212 widens or extends an axial width 205W (shown in FIG. 7) of faceplate 202. Lip 212 and radially outer end 205 of faceplate 202 are configured to physically contact or engage the inner surface 106 of carrier 102 to provide electrical conduction therebetween, thereby assisting in the grounding of detonator 50. Although in this embodiment faceplate 202 of lower endplate 200 includes curved lip 212, in other embodiments, faceplate 202 may not include curved lip 212.

In this embodiment, faceplate 202 includes a radially extending alignment tab 214 that extends radially outwards from radially outer end 205 and is receivable in slot 116 of carrier to restrict relative rotation between lower endplate 200 and carrier 102. Alignment tab 214 of faceplate 202 may also assist in grounding detonator 50 by contacting the inner surface 106 of carrier 102. Further, in this embodiment, faceplate 202 includes at least one ground tab 216 (shown in FIGS. 3 and 5) that extends axially into the central passage 122 of charge tube 120. Ground tab 216 includes an aperture for receiving fastener 130, thereby securing lower endplate 200 to charge tube 120. Additionally, physical contact between fastener 130 and ground tab 216 provides an electrically conductive connection between charge tube 120 and faceplate 202 of lower endplate 200. In conjunction with the physical contact provided by curved lip 212 and ground springs 208 with carrier 102 and plug-shoot firing head 32, respectively, an electrically conductive connection is formed between ground wire 52 (which physically contacts the outer surface 124 of charge tube 120 to provide an electrically conductive connection therebetween) and both the plug-shoot firing head 32 and carrier 102 to ground detonator 50 with both plug-shoot firing head 32 and the carrier 102 of perforating gun 100.

In this embodiment, the molded portion 230 of lower endplate 200 is generally annular in shape and includes a radially extending alignment tab 234 and a plurality of circumferentially spaced coupling tabs 236 that extend axially into the central passage 122 of charge tube 120. Alignment tab 234 of molded portion 230 may be received in the alignment slot 116 of carrier 102 to assist with angularly aligning charge tube 120 with carrier 102. Additionally, at least some of the coupling tabs 236 include an aperture that receives a corresponding fastener 130 to assist with securing lower endplate 200 with charge tube 120. In this embodiment, the ground tab 216 of faceplate 202 extends through at least one of the coupling tabs 236 of molded portion 230. In this configuration, molded portion 230 of lower endplate 200 may comprise a material that is less expensive than the electrically conductive material comprising faceplate 202, thereby reducing the overall cost of lower endplate 200 (relative to an all metallic or electrically conductive endplate) while still providing for the grounding of detonator 50 at perforating gun 100 via the features of faceplate 202 described above.

Referring to FIGS. 1-3 and 8-10, an embodiment of upper endplate 250 is shown in FIGS. 3 and 8-10. In the embodiment of FIGS. 3 and 8-10, upper endplate 250 is generally annular and comprises an annular faceplate 252, and an annular body or molded portion 280 coupled to faceplate 252. Faceplate 252 comprises the same or similar materials as faceplate 202 of lower endplate 200 while molded portion 280 of upper endplate 250 comprises the same or similar materials as the molded portion 230 of lower endplate 200. Thus, faceplate 252 of upper endplate 250 comprises an electrically conductive material while molded portion 280 does not necessarily comprise an electrically conductive material. Further, the materials comprising molded portion 280 are less expensive than the materials comprising faceplate 252, thereby reducing the overall cost of lower endplate 252 relative to an endplate comprising entirely or substantially the materials forming faceplate 252. Although in this embodiment molded portion 280 is molded to faceplate 252, in other embodiments, molded portion 280 may comprise a body that is mechanically connected to faceplate 252, such as using releasable or permanently coupled fasteners.

In this embodiment, faceplate 252 includes an annular surface 254 extending radially between a radially inner end 253 and a radially outer end 255. The radially inner end 253 of faceplate 252 includes a plurality of circumferentially spaced arcuate recesses 256 that assist with securing faceplate 252 to molded portion 280. Additionally, in this embodiment, an annular curved or rounded lip 258 extends between the radially outer end 255 and annular surface 254 of faceplate 252. Similar to curved lip 212 of the faceplate 202 of lower endplate 200, curved lip 258 of faceplate 252 widens or extends an axial width 255W (shown in FIG. 10) of faceplate 252. Lip 258 and radially outer end 255 of faceplate 252 are configured to physically contact or engage the inner surface 106 of carrier 102 to provide electrical conduction therebetween, thereby assisting in the grounding of detonator 50. Although in this embodiment faceplate 252 of upper endplate 250 includes curved lip 258, in other embodiments, faceplate 252 may not include curved lip 258. Additionally, in this embodiment, engagement between ground springs 208 of lower endplate 200 and the end of plug-shoot firing head 32 biases annular surface 254 into physical contact or engagement with the retainer ring 114 positioned adjacent upper endplate 250. Contact between annular surface 254 and retainer ring 114 allows electrical conduction between charge tube 120 and carrier 102 (which contacts retainer ring 114), assisting with the grounding of detonator 50 at perforating gun 100.

In this embodiment, faceplate 252 includes at least one ground tab 260 (shown in FIG. 3) that extends axially into the central passage 122 of charge tube 120. Similar in configuration to ground tab 216 of the faceplate 202 of lower endplate 200, ground tab 260 of faceplate 252 includes an aperture for receiving fastener 130, thereby securing upper endplate 250 to charge tube 120. Additionally, physical contact between fastener 130 and ground tab 260 provides an electrically conductive connection between charge tube 120 and faceplate 252 of upper endplate 250. In conjunction with the physical contact provided by annular surface 254 and curved lip 258 with retainer ring 114 and carrier 102, respectively, an electrically conductive connection is formed between ground wire 52 and carrier 102 via upper endplate 250 and retainer ring 114 to ground detonator 50 at perforating gun 100.

In this embodiment, the molded portion 280 of upper endplate 250 is generally annular in shape and includes a generally cylindrical inner surface that defines a central aperture or passage 282 of upper endplate 250. Central passage 282 of upper endplate 250 has a smaller diameter than the central passage 206 of lower endplate 200 to thereby restrict the communication of pressure from discharged shaped charges coupled to charge tube 120 (following the firing of perforating gun 100) with components (e.g., electrical components, etc.), such as first electrical connector 31, housed in switch sub 30. However, in other embodiments, the diameter of the central passage 282 of lower endplate 280 may be the same as or greater than the diameter of the central passage 206 of lower endplate 200. In still other embodiments, the diameter of the central passage 206 of lower endplate 200 may be reduced to match the diameter of the central passage 282 of upper endplate 250.

In this embodiment, molded portion 280 of upper endplate 250 comprises a plurality of circumferentially spaced coupling tabs 284 that extend axially into the central passage 122 of charge tube 120. In this embodiment, at least some of the coupling tabs 284 include an aperture that receives a corresponding fastener 130 to assist with securing upper endplate 250 with charge tube 120. In this embodiment, the ground tab 260 of faceplate 252 extends through at least one of the coupling tabs 284 of molded portion 280. In this configuration, molded portion 280 of upper endplate 250 may comprise a material that is less expensive than the electrically conductive material comprising faceplate 252, thereby reducing the overall cost of upper endplate 250 while still providing for the grounding of detonator 50 at perforating gun 100.

Figure 11:
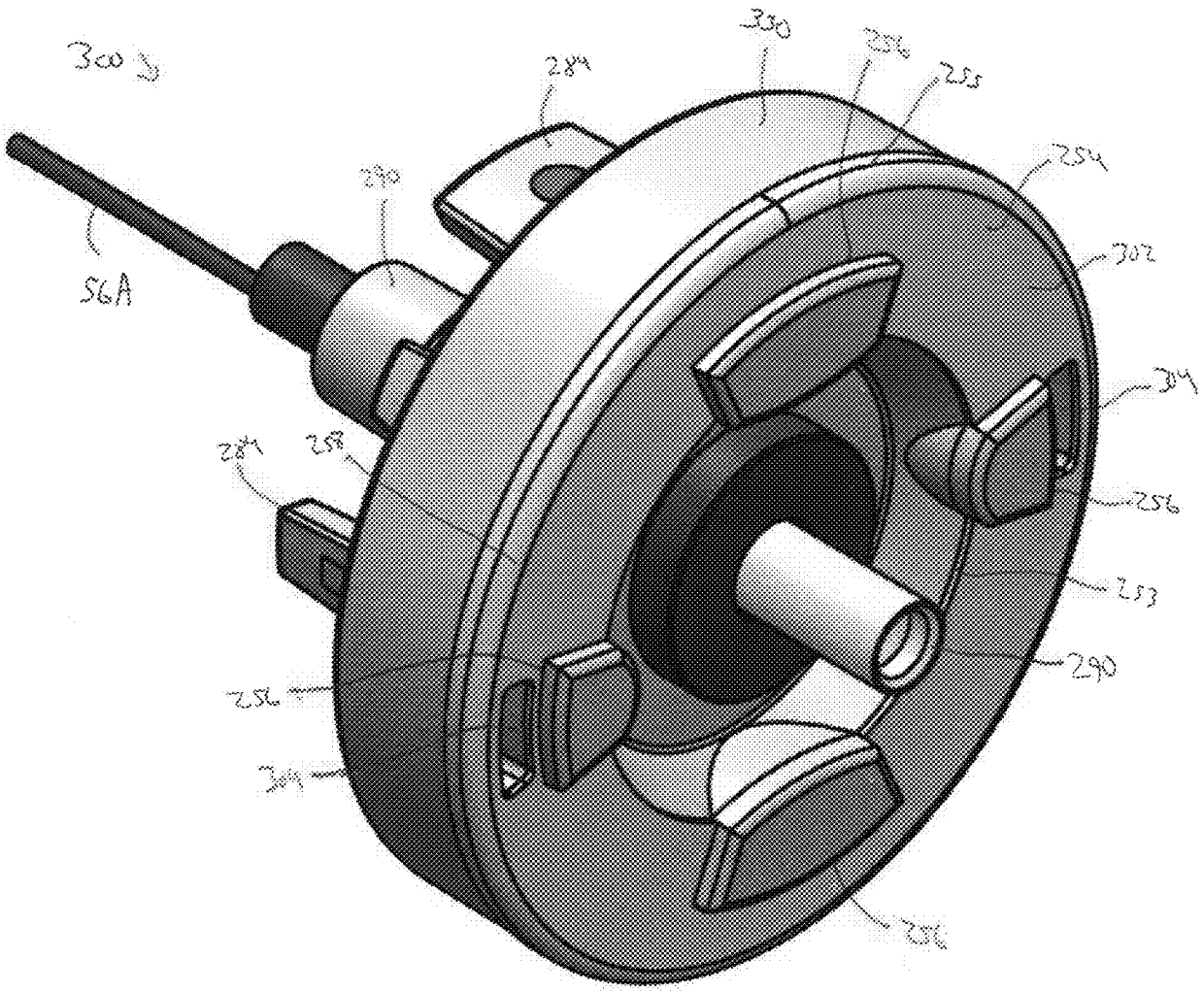
FIG. 11 is a perspective view of another embodiment of an endplate of the perforating gun of FIG. 2 in accordance with principles disclosed herein.
Figure 12:
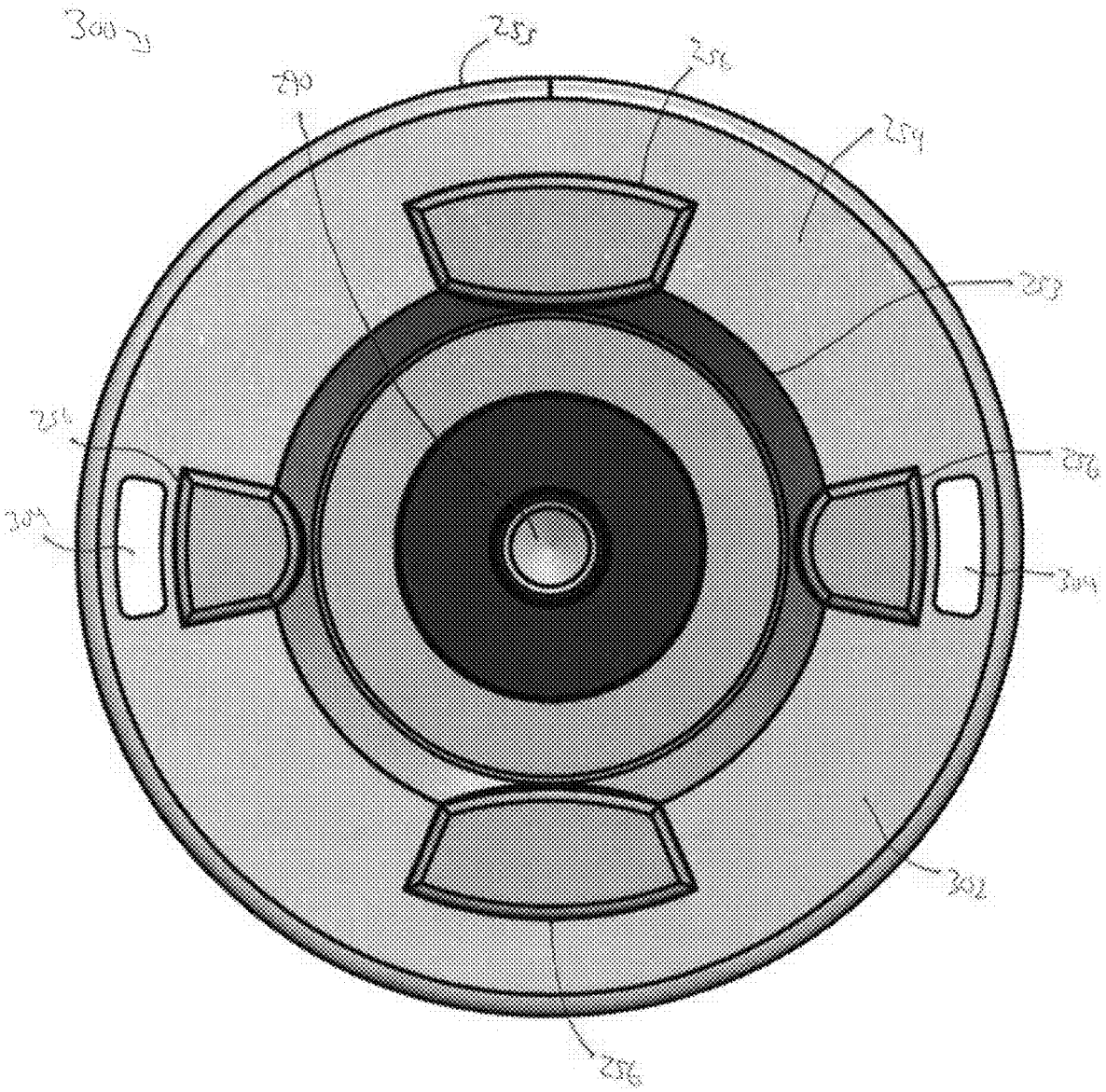
FIG. 12 is a front view of the endplate of FIG. 11.

Referring to FIGS. 1-3, 11, and 12, another embodiment of an upper endplate 300 of the perforating gun 100 of FIGS. 1-3 is shown in FIGS. 11, 12. Upper endplate 300 includes features in common with the upper endplate 250 shown in FIGS. 3, 8-10, and shared features are labeled similarly. Particularly, upper endplate 300 is similar to upper endplate 250 expect that a faceplate 302 of upper endplate 300 includes a plurality of circumferentially spaced ports 304 that extend through annular faceplate 302 and an annular body or molded portion 330 of upper endplate 300. Ports 304 of upper endplate 300 provide for the communication of pressure from the central passage 122 of charge tube 120 to a passage of switch sub 30 following the firing of perforating gun 100. In this embodiment, upper endplate 300 includes a pair of arcuate ports 304 spaced approximately 180 degrees apart; however, in other embodiments, faceplate 302 of upper endplate 300 may include varying numbers of ports 304, and ports 304 may comprise different shapes.

Ports 304 may be utilized to communicate pressure in embodiments where the communication of pressure is prevented or restricted through the central passage 282 of upper endplate 300. For instance, in this embodiment, an embodiment of second electrical connector 290 is received in central passage 282 of upper endplate 300, limiting the communication of pressure therethrough. In this configuration, pressure may be communicated to central passage 122 of charge tube 120 via ports 304.

Figure 13:
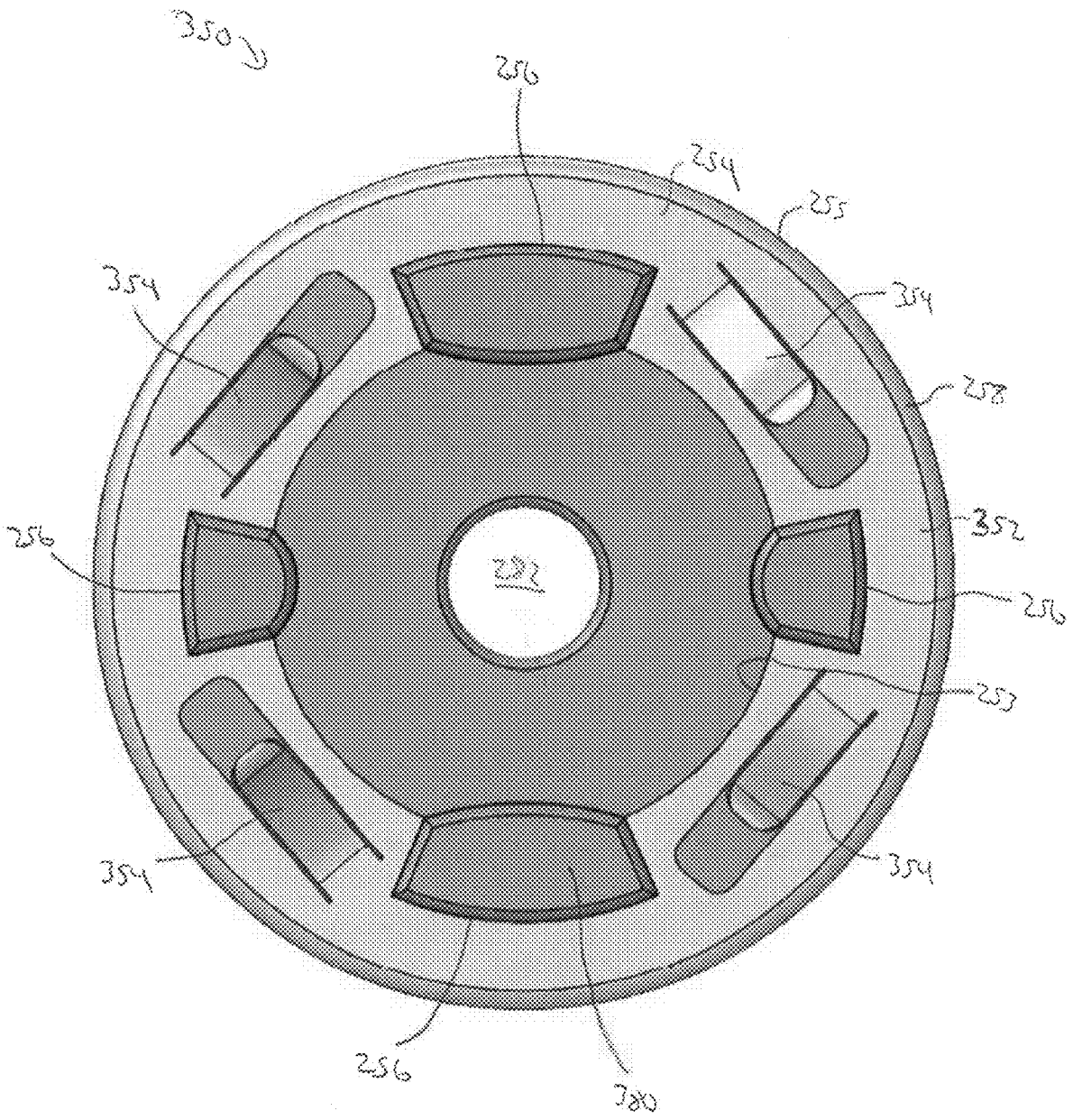
FIG. 13 is a front view of another embodiment of an endplate of the perforating gun of FIG. 2 in accordance with principles disclosed herein.
Figure 14:
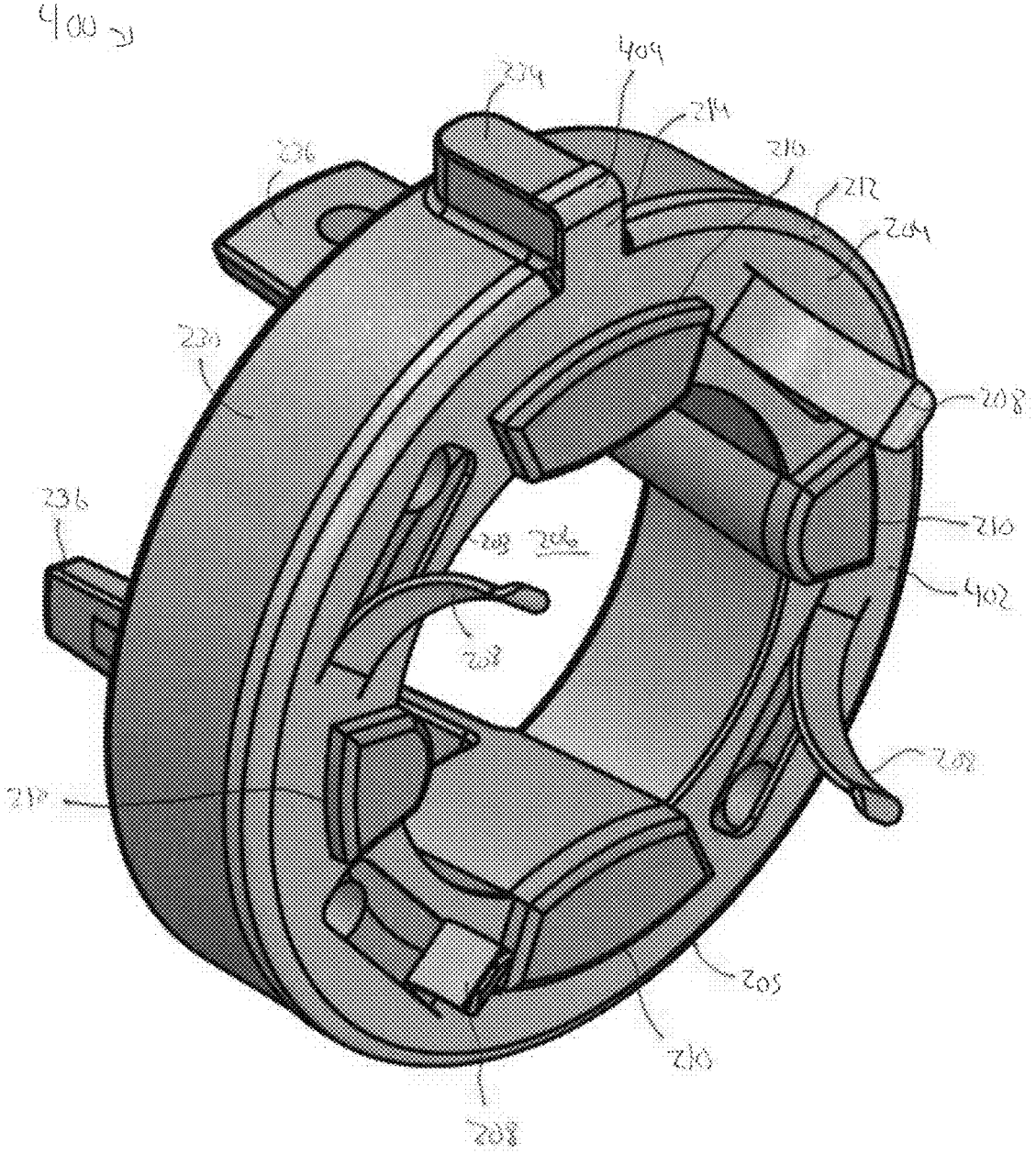
FIG. 14 is a perspective view of another embodiment of an endplate of the perforating gun of FIG. 2 in accordance with principles disclosed herein.

Referring to FIGS. 1-3 and 13, another embodiment of a upper endplate 350 of the perforating gun 100 of FIGS. 1-3 is shown in FIG. 13. Upper endplate 350 includes features in common with the upper endplate 250 shown in FIGS. 3 and 8-10, and shared features are labeled similarly. Particularly, upper endplate 350 is similar to upper endplate 250 expect that a faceplate 352 of upper endplate 350 includes a plurality of circumferentially spaced ground members or springs 354 that extend axially outwards from annular surface 204. Ground springs 354 are biased in an axially outwards direction from annular surface 204 such that ground springs 354 may remain in physical contact or engagement with an end of switch sub 30, thereby allowing for electrical conduction between switch sub 30 and the faceplate 352 of upper endplate 350 and assisting in the grounding of detonator 50.

Referring to FIGS. 1-3 and 14, another embodiment of a lower endplate 400 of the perforating gun 100 of FIGS. 1-3 is shown in FIG. 11. Lower endplate 400 includes features in common with the lower endplate 200 shown in FIGS. 3-7, and shared features are labeled similarly. Particularly, lower endplate 400 is similar to lower endplate 200 expect that the alignment tab 214 of a faceplate 402 of lower endplate 400 includes a curved or rounded lip 404 that defines a radially outer end of alignment tab 214. Similar to curved lip 212, the curved lip 404 of the alignment tab 214 of lower endplate 400 widens or extends an axial width of alignment tab 214. Thus, in this configuration, curved lip 404 of the alignment tab 214 assists in ensuring contact between alignment tab 214 and the inner surface 106 of carrier 102 and the grounding of detonator 50.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A charge tube assembly for a perforating gun, comprising:

a charge tube configured to receive an explosive shaped charge; and a first endplate configured to couple to a first end of the charge tube, the first endplate including a first faceplate coupled to a first body comprising a molded portion that is molded to the first faceplate, wherein the first faceplate comprises a first material and the first body comprises a second material that is different from the first material.

2. The charge tube assembly of claim 1, further comprising a second endplate configured to couple to a second end of the charge tube, the second endplate including a second faceplate coupled to a second body, and wherein the second faceplate comprises a third material and the second body comprises a fourth material that is different from the third material.

3. The charge tube assembly of claim 1, wherein the first material comprises an electrically conductive material and the second material comprises an electrically insulating material.

4. The charge tube assembly of claim 1, wherein the first faceplate comprises an annular surface having radially inner and outer ends and wherein the body comprises a central passage.

5. The charge tube assembly of claim 4, wherein the first faceplate comprises a ground spring that extends from the annular surface of the first faceplate.

6. The charge tube assembly of claim 4, wherein the first faceplate comprises a ground tab that extends from the annular surface, and wherein the ground tab is configured to receive a fastener to couple the first endplate with the charge tube.

7. The charge tube assembly of claim 4, wherein:

the first faceplate comprises an alignment tab that extends radially outward from the radially outer end of the first faceplate, and wherein the alignment tab is configured to angularly align the charge tube with a housing of the perforating gun; and the alignment tab comprises a rounded lip.

8. The charge tube assembly of claim 4, wherein the first faceplate comprises a port extending through the annular surface of the first faceplate, and wherein the port is configured to communicate pressure from a central passage of the charge tube when the first endplate is coupled to the charge tube.

9. The charge tube assembly of claim 4, wherein the radially outer end of the first faceplate comprises a rounded lip.

10. A perforating gun, comprising:

a housing comprising an inner surface;

a charge tube insertable into the housing and configured to receive an explosive shaped charge; and a first endplate configured to couple to a first end of the charge tube, the first endplate including a first faceplate coupled to a first body, wherein the first faceplate comprises a first material and the first body comprises a second material that is different from the first material;

wherein the first faceplate comprises an annular surface having a radially inner end and a radially outer end comprising a rounded lip.

11. The perforating gun of claim 10, wherein the first material comprises an electrically conductive material and the second material comprises an electrically insulating material.

12. The perforating gun of claim 10, wherein the first body comprises a molded portion that is molded to the first faceplate.

13. The perforating gun of claim 10, wherein:

the body comprises a central passage;

the first faceplate comprises a ground tab that extends from the annular surface, and wherein the ground tab is configured to receive a fastener to couple the first endplate with the charge tube; and the first faceplate comprises an alignment tab that extends radially outward from the radially outer end of the first faceplate, and wherein the alignment tab is insertable into an alignment slot formed in the inner surface of the housing.

14. The perforating gun of claim 13, wherein the alignment tab of the first faceplate comprises a rounded lip.

15. The perforating gun of claim 10, further comprising a second endplate configured to couple to a second end of the charge tube, the second endplate including a second faceplate coupled to a second body, and wherein the second faceplate comprises a third material and the second body comprises a fourth material that is different from the third material.

16. A charge tube assembly for a perforating gun, comprising:

a charge tube configured to receive an explosive shaped charge; and a first endplate configured to couple to a first end of the charge tube, the first endplate including a first faceplate coupled to a first body, wherein the first faceplate comprises a first material and the first body comprises a second material that is different from the first material;

wherein the first faceplate comprises an annular surface and a plurality of circumferentially spaced ground springs which extend from the annular surface.

17. The charge tube assembly of claim 16, wherein the first body comprises a molded portion that is molded to the first faceplate.

18. The charge tube assembly of claim 16, further comprising a second endplate configured to couple to a second end of the charge tube, the second endplate including a second faceplate coupled to a second body, and wherein the second faceplate comprises a third material and the second body comprises a fourth material that is different from the third material.

19. The charge tube assembly of claim 16, wherein the first material comprises an electrically conductive material and the second material comprises an electrically insulating material.

* * * * *